US008224004B2

(12) United States Patent
Baechler et al.

(10) Patent No.: US 8,224,004 B2
(45) Date of Patent: Jul. 17, 2012

(54) PROGRAMMABLE REMOTE CONTROL

(75) Inventors: Herbert Baechler, Meilen (CH); Hilmar Meier, Zurich (CH); Michael Boretzki, Rueti (CH)

(73) Assignee: Phonak AG, Staefa (CH)

( * ) Notice: Subject to any disclaimer, the term of this patent is extended or adjusted under 35 U.S.C. 154(b) by 1304 days.

(21) Appl. No.: 11/530,048

(22) Filed: Sep. 8, 2006

(65) Prior Publication Data

US 2007/0071264 A1 Mar. 29, 2007

(51) Int. Cl.
*H04R 25/00* (2006.01)

(52) U.S. Cl. ..... 381/315; 381/312; 381/314

(58) Field of Classification Search ..... 381/60, 381/312, 314, 315, 323; 455/418, 419, 420, 455/557, 556.1; 600/559; 607/56, 57
See application file for complete search history.

(56) References Cited

U.S. PATENT DOCUMENTS

| | | | | |
|---|---|---|---|---|
| 5,710,819 | A | 1/1998 | Topholm | |
| 5,721,783 | A | 2/1998 | Anderson | |
| 6,229,900 | B1 | 5/2001 | Leenen | |
| 6,850,775 | B1 * | 2/2005 | Berg | 455/556.1 |
| 6,978,155 | B2 | 12/2005 | Berg | |
| 2005/0105751 | A1 | 5/2005 | Arz et al. | |
| 2007/0009124 | A1 * | 1/2007 | Larsen | 381/315 |

FOREIGN PATENT DOCUMENTS

| | | | |
|---|---|---|---|
| DE | 19716486 | A1 | 9/1998 |
| EP | 0823829 | A2 | 2/1998 |
| EP | 0964603 | A1 | 12/1999 |
| EP | 1519623 | A2 | 3/2005 |
| WO | 2004098238 | A2 | 11/2004 |
| WO | 2005/098238 | A1 | 10/2005 |

OTHER PUBLICATIONS

International Search Report dated Jun. 7, 2007.

* cited by examiner

*Primary Examiner* — Huyen D Le
(74) *Attorney, Agent, or Firm* — Pearne & Gordon LLP

(57) ABSTRACT

A hearing system includes a hearing device with a signal processing unit. A control input of the signal processing unit is connected to a device communication port. A remote control device has a wireless communication port for single or bi-directional wireless communication with the device communication port. A computer is embedded in the remote control device. An output of the computer is connected to the wireless communication port and to a machine/man interface at the remote control device. An input of the computer is connected to a man/machine interface at the remote control device. A set of application programs is executable by the computer.

10 Claims, 3 Drawing Sheets

PROGRAMMABLE REMOTE CONTROL

Figure 1:
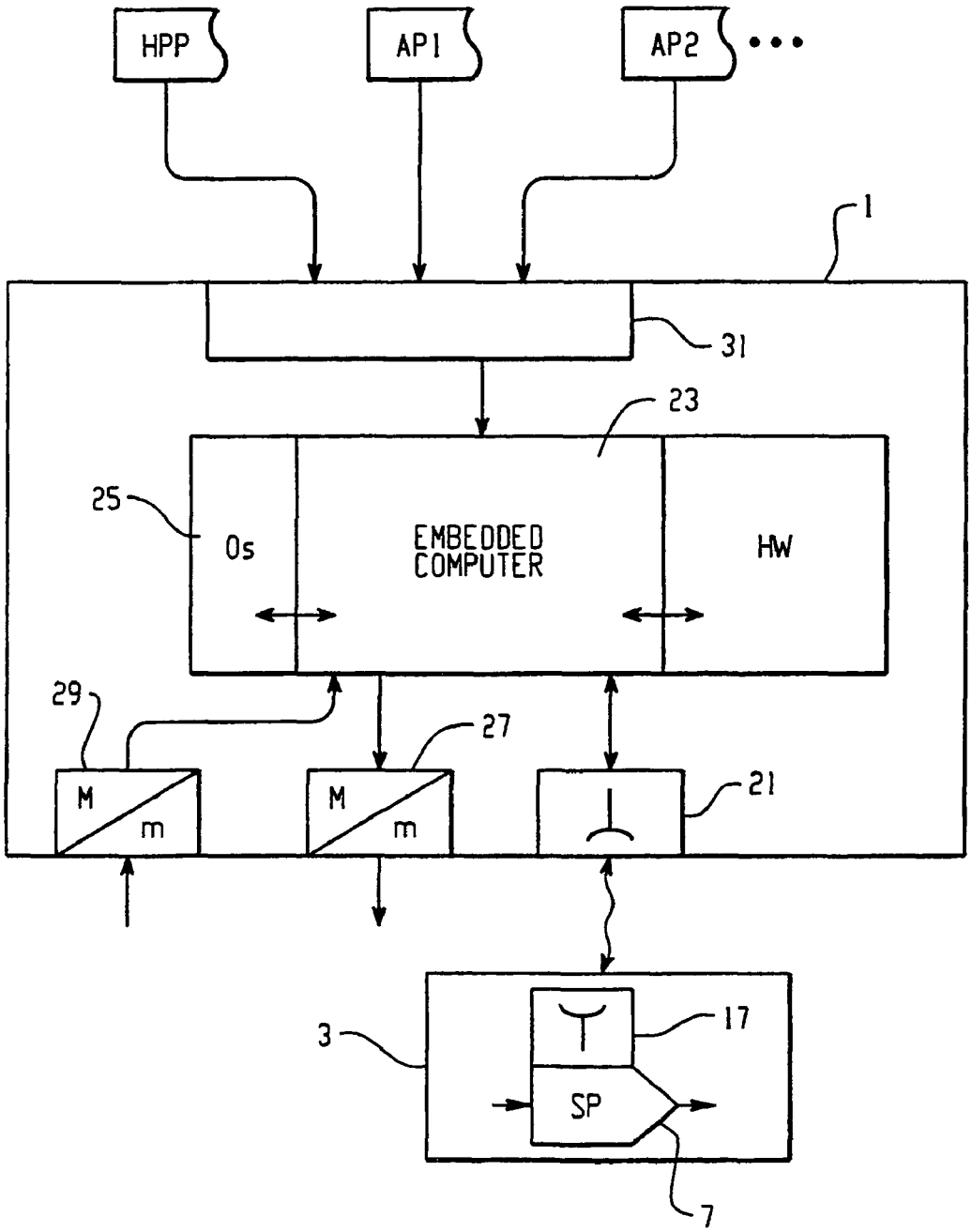

The present invention is generically directed on a hearing system with at least one hearing device and with a remote control device which is in wireless communication with the hearing device as well as to establishing such mutual communication.

DEFINITION

We understand under a "hearing device" a device which is worn adjacent to or in an individual's ear with the object to improve individual's acoustical perception. Such improvement may also be barring acoustical signals from being perceived in the sense of hearing protection for the individual.

If the hearing device is tailored so as to improve the perception of a hearing impaired individual towards hearing perception of a "standard" individual, then we speak of a hearing aid device.

With respect to the application area a hearing device may be applied behind the ear, in the ear, completely in the ear canal or may be implanted.

A hearing device may also be binaural, i.e. comprising a pair of subdevices, one for each of an individual's ears, whereby these subdevices are in mutual wire-bound or wireless communication.

Hearing systems of the addressed kind or similar are widely known and addressed e.g. in the following documents: U.S. Pat. No. 5,710,819, EP 0 823 829, U.S. Pat. No. 6,229,900, US 2005/0105751, WO 2004/098238, U.S. Pat. No. 6,978,155, U.S. Pat. No. 5,721,783, EP 0 964 603.

Thereby, it is frequent to attribute to the involved remote control device "programmability". Such programmability nevertheless addresses the ability to control and program a signal processing unit in the hearing device.

In spite of the fact that it has been recognized that remote controls are easy going and elegant to control hearing devices when compared e.g. with small switches and wheels mounted on behind-the-ear hearing devices, in-the-ear hearing devices or even completely-in-the-canal hearing devices, such remote control devices are not as widely used as one would think. Apparently not every individual is motivated to carry an additional little box, additional to today's customary mobile phone and PDA.

It is an object of the present invention to address this drawback and to provide a hearing system with remote control device having an increased acceptability by customers.

This is realized by a hearing system with at least one hearing device having a controllable signal processing unit. The signal processing unit has a control input which is operationally connected to a device communication port.

The hearing system according to the present invention further comprises a remote control device having a wireless communication port 21 for single- or bi-directionally and wirelessly communicating with the device communication port. The remote control device according to the invention further comprises an embedded computer which is operated by an operating system.

DEFINITION

We apply for the term "computer" and "embedded computer" the definitions as stated in "Wikipedia": Thereby, an "embedded system" or "embedded computer" is a special-purpose computer completely encapsulated by the device it controls. Unlike a general-purpose computer such an embedded computer performs pre-defined tasks, usually with very specific requirements. Since the system is dedicated to a specific task, design engineers can optimize it reducing the size and costs of the product. Embedded systems are often mass-produced, so that the cost savings may be multiplied by millions of items. Also hand-held computers or PDA are generally considered embedded devices because of the nature of their hardware design, even though they are more expandable in software terms.

Throughout the present invention we understand under "embedded computer" a device which is completely encapsulated in the remote control device, but which, in analogy to hand-held computers or PDAs, is highly expandable in the addressed software terms.

The addressed embedded computer according to the present invention is operated by an operating system, defined again according to "Wikipedia", that manages the hardware and software resources of the embedded computer. The operating system performs basic tasks, such as controlling and allocating memory, prioritizing the processing of instructions, controlling input and output devices, facilitating networking and managing files.

Turning back to the hearing system according to the present invention an output of the embedded computer is operationally connected to the communication port and to at least one machine/man interface at the remote control device. An input of the addressed embedded computer is operationally connected to at least one man/machine interface at the remote control device. There is further provided at the system according to the present invention a set of application programs which are selectably executable by the embedded computer.

As recognized by the skilled artisan, providing in the remote control device the operating system controlled embedded computer, it becomes possible, whenever the hardware of the remote control device is accordingly equipped, to perform a large variety of application programs and thus to use the addressed remote control device for a huge number of appliances different from and additional to its intrinsic remote control function for the hearing device. Thereby, given a number of such different appliances by respective application programs and hardware configuration, it is an important option that the selection as to which of the addressed appliances are really activated, is done in dependency of the individual for whom the hearing device system is fitted.

As an example, whereas for young people camera options, audio, video, radio or TV player options will be most attractive, such options or appliances, which, naturally, complicate handling of the remote control device, will mostly not be desired if the addressed individual is of higher age.

Thus, a further principle followed up by the present invention is to provide a multitude of options, also named appliances, at the system with respect to the use of the remote control device and programming such remote control device per se, e.g. in dependency of individual's need. Thereby, one could say that the remote control device per se is individually fitted.

In spite of the fact that it is absolutely possible to load just those application programs into the remote control device which are individually desired, it has to be considered that the need of an individual with respect to such application programs running on his remote control device may change.

Therefore and in one embodiment at least a part of all application programs which are executable by the embedded computer are commonly installed but are selectively activated via a man/machine interface of the remote control device. Either the user individual himself or a fitting person as e.g. an audiologist selectively activates or deactivates application programs via the addressed man/machine interface. Loading application programs to the remote control device may thereby be performed e.g. via a further wireless communication link to the remote control device as e.g. via internet or by a personal computer and a respective communication link or by a memory stick or memory card introduced to a respective port at the remote control device.

As was already addressed, in one embodiment of the invention, out of a multitude of application programs which are executable by the remote control device with its embedded computer, a selection of application programs which are actively executed is made in dependency of the needs of the individual who carries or who shall carry the hearing device system.

Further, it had to be considered that different hearing devices need different hearing device-specific programs, e.g. to differently operate the signal processing units in such hearing devices.

Thus and in a further embodiment of the present invention, wherein a multitude of application programs are executable by the remote control device with the embedded computer, a selection of those application programs which are actively operated is made in dependency of the hearing device which is linked or to be linked to the remote control device.

In a further embodiment the addressed selection is made automatically upon identification of the hearing device which is linked to the remote control device.

Under a more generic aspect of the present invention and of the further embodiment just addressed, the remote control device selects its operation and thereby more specifically the addressed selection automatically upon identification of a hearing device to be linked to the remote control device.

Under a further aspect of the present invention, vice versa, a hearing device which has specific options as e.g. a specific number of signal processing programs, the option to transmit to the remote control specific types of audio signals etc., does automatically recognize the options which are present at a specific remote control device upon identification of the remote control device by the hearing device involved so that the mutual communication between the hearing device and the remote control device may be adapted on the side of the hearing device.

Thus, in a combined consideration, the remote control device and the hearing device may mutually identify each other automatically, so as to establish a respective communication which is adapted to the options which are operatable at both devices.

Turning back, still under a further embodiment of the present invention, in the system whereat at least a part of the application programs are commonly installed and selectively activatable via at least one man/machine interface, activation and setting of options for the respective application programs is performed under menu control at the remote control device.

Still in a further embodiment the machine/man interface at the remote control device comprises at least one of the following units:

A color display, a loudspeaker unit, an output electrical/acoustical converter built in the unit and/or such converter of the hearing device or an output connection plug at the remote control device.

Still in a further embodiment the addressed man/machine interface comprises at least one of the following units:

A touch-screen, a microphone, a keypad, an input acoustical to electrical converter at the remote control unit and/or at the hearing device or an input connection plug at the remote control device. Clearly, such addressed connection plugs may be e.g. USB plugs, Firewire plugs etc. as customary for more sophisticated devices with embedded computers.

Still in a further embodiment the remote control device comprises an input unit for loading application programs. Such an input unit may be realized e.g. by a card reader, a USB input e.g. for a memory stick, a Firewire input. The addressed application programs may also be loaded to the remote control device via a wireless—e.g. Bluetooth—or cable-bound connection from a remote computer. A further possibility to load such application programs is via a wireless communication link directly from a private or public network, e.g. from internet. This especially if the remote control device is configured with respect to hardware as well as application programs to act also as a mobile phone.

In one embodiment of the system according to the invention the remote control device is operatable as at least one of: a PDA, a mobile phone, a radio broadcast receiver, e.g. for FM broadcast, a video player, an audio player, a TV receiver and player, a camera, be it for still images or for video, a remote control for devices different from the hearing device e.g. for a remote TV, a remote stereo equipment, a fitting control device for the hearing device, a communication transit unit between the hearing device and a remote information system.

Figure 2:
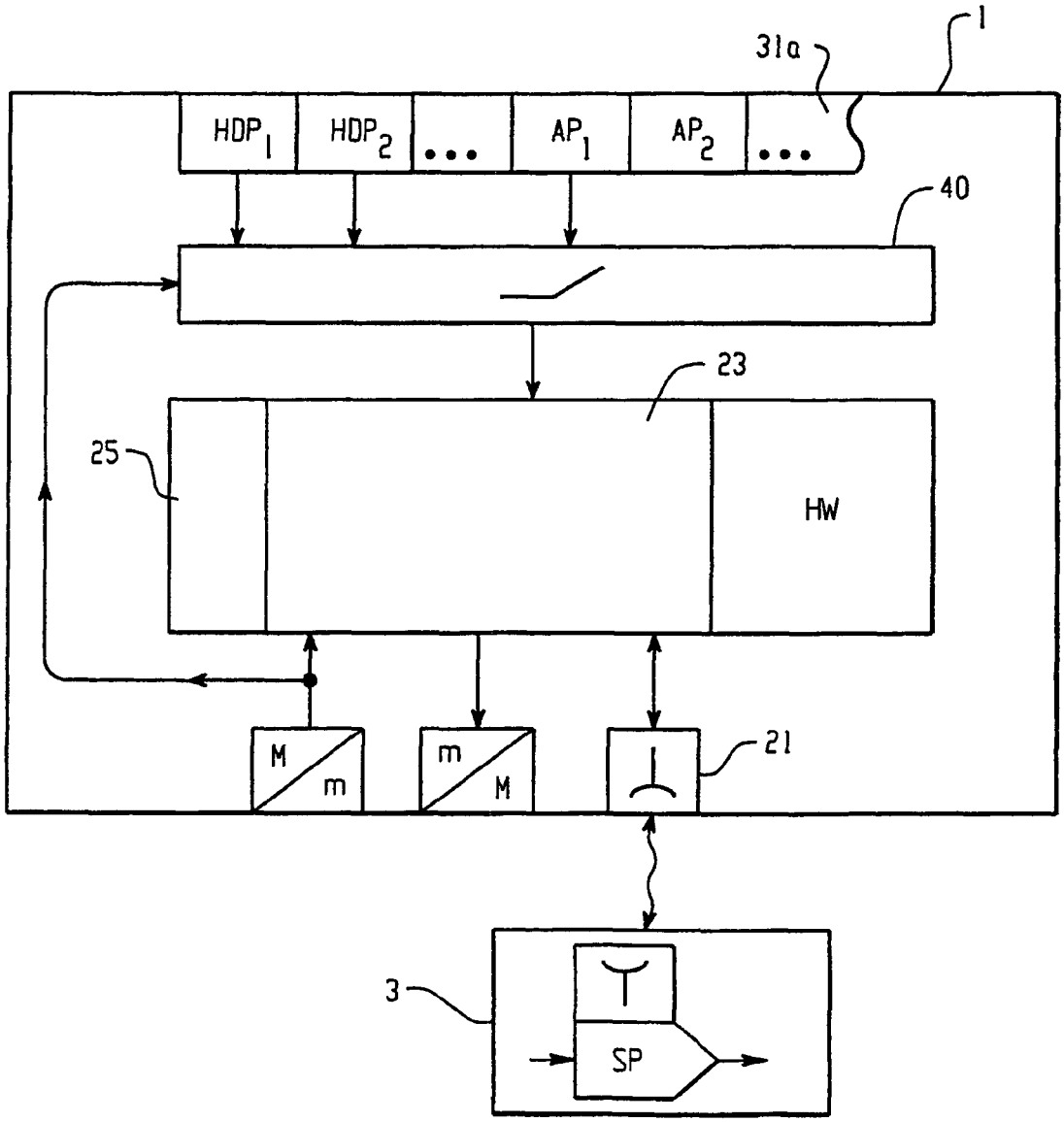
Figure 3:
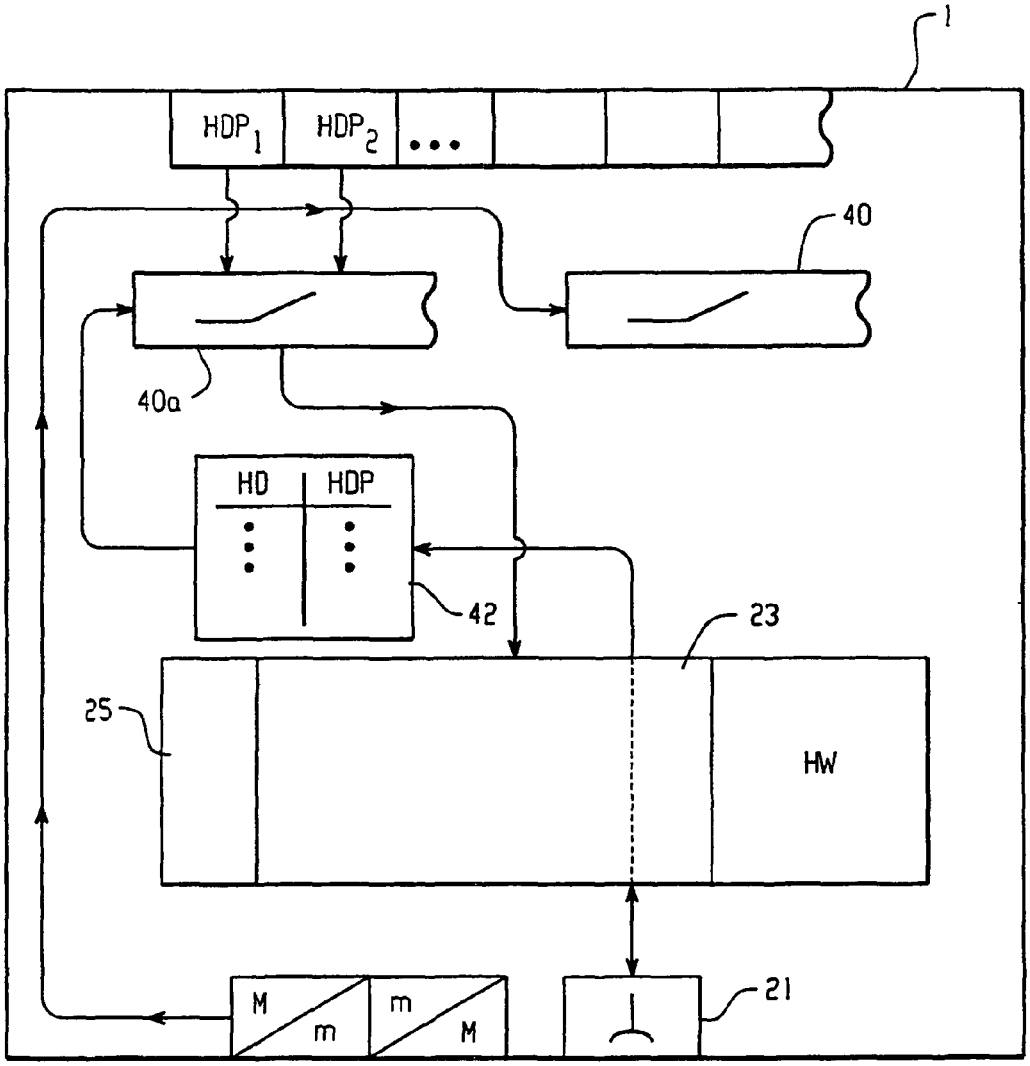

The present invention shall now be further explained as far as at all necessary for the skilled artisan by means of examples and with the help of figures. The figures show:

FIG. 1 by means of a simplified block representation, a system according to the present invention;

FIG. 2 departing from a representation in analogy to that of FIG. 1, a further embodiment of a system according to the present invention, and FIG. 3 still in a representation in analogy to that of FIG. 1, a further embodiment of the system according to the present invention The hearing system according to the present invention and as schematically shown in FIG. 1, comprises a remote control device 1 and hearing device 3. The hearing device 3 may be conceived in fact in any known manner.

The hearing device 3 has a signal processing unit 7 by which, as perfectly clear to the skilled artisan, signal transfer characteristics between the output of a microphone arrangement, as an acoustical-to-electrical converter and the input of a loudspeaker arrangement, as an electrical-to-mechanical converter of the hearing device, is established.

The signal processing unit 7 has thereby a control input (not specifically shown in FIG. 1) which is operationally connected to a device communication port 17 schematically shown in FIG. 1 by an aerial.

The remote control device 1 comprises an embedded computer unit 23 which is operated by an operating system OS schematically shown in operating system storage 25. The embedded computer unit 23 has an output which is operationally connected to a machine/man interface 27 and has an input which is operationally connected to a man/machine interface 29.

The remote control device 1 further comprises, as schematically shown, an application program storage 31. Application programs which are stored within application program storage 31 control the operation of the embedded computer unit 23 on a higher level. On basic level and as perfectly known to the skilled artisan the embedded computer unit 23 is operated by the operating system in operating system storage 25.

Within application program storage 31 there is on one hand and mandatorily, at least one program by which operation of the hearing device 3 is controlled. By this application program in application storage 31 and controlled by the man/ machine interface 29, the hearing device 3, thereby especially the signal processing unit 7, is controlled e.g. to operate in different signal processing modes, the hearing device is switched on and off, the volume is adjusted, etc. By such hearing device application program HDP all functions are performed which are expected from a remote control for a hearing device. With the program HDP the remote control device according to the invention is just a remote control device for the hearing device.

According to the representation of FIG. 1 application program HDP controlling the hearing device is practically always loaded in the application program storage 31 so as to realize remote control function for the hearing device 3. Considering that different hearing devices 3 and/or different individual needs with respect to operation of the hearing device 3 should be served or fulfilled respectively by one unique remote control device 1, different hearing device-specific application programs HDP may be loaded into application program storage 31 to become selectively activated to control the embedded computer unit 23.

Additional, not directly hearing device-referred application of programs AP1, AP2 etc., belong to the overall system as shown in FIG. 1 and may be loaded into the application program storage 31 to become selectively active with respect to the control of the embedded computer unit 23. Which kind of application programs AP may be loaded into application storage 31 and may be selected so as to become active in controlling embedded computer unit 23 is also dependent from the overall hardware configuration HW of the remote control device 1.

The machine/man interface 27 which is shown in FIG. 1 and which in fact is a part of the hardware HW configuration comprises a graphical user interface which is a visual display, e.g. an LCD display, whereat color, brightness, font, background and picture representation may be set and controlled assisted by a respective menu display. By such menu control the language, time, date etc. may be set and displayed, status information of the hearing device as well as of the remote control device 1 may be selected to be displayed, e.g. loudness, volume, processing program at the signal processing unit 7, etc.

The hardware of the remote control device 1 may further comprise a loudspeaker arrangement for audio display, may further comprise hardware components for PDA appliance, for mobile phone appliance, for radio broadcast, for video player, TV receiver and player, video or still picture camera appliances, for remote control of devices different from the hearing device 3, for fitting of the hearing device 3, for establishing wireless transit communication between the hearing device 3 and a remote information system as e.g. to a remote server.

Accordingly and just as an example the application programs which are loadable into the application program storage 31 provide for control of the embedded computer unit 23—dependent from the addressed hardware configuration—e.g. for PDA, mobile phone, radio broadcast receiver, video player, audio player, TV receiver and player, still picture or video picture camera, remote control for devices different from the hearing device 3, for fitting of the hearing device 3, for communication transit between the hearing device 3 and a remote information system etc., so that dependent on which application programs AP1 are loaded in application program storage 31 the remote control device 1 operates as for one or more than one of the addressed appliances.

As perfectly clear to the skilled artisan further application programs may be loaded into application program storage 31 as e.g. word processing programs, calculator programs, photo treatment programs, etc., etc. Thereby, as was addressed, an application program HDP for the control of the hearing device 3 is always loaded into application program storage 31, unless the remote control device is momentarily to be used as a device which is not linked to a hearing device e.g. for a person who wears no hearing device.

With respect to the application programs AP the selection which programs shall be active with respect to control of the embedded computer unit 23 may in one embodiment be made before loading the respective programs into the application program storage 31. In such a case programs loaded into storage 31 are executed.

In another embodiment and as will be described later, a number of application programs AP are loaded into storage 31 and selection as to which of these programs is or are activated with respect to control of the embedded computer unit 23 is done by man afterwards.

Some examples shall now be given how the system as schematically shown in FIG. 1 may be used additionally to its intrinsic hearing device remote control ability.

The remote control device 1 may generate a number of messages or may even receive such messages by its mobile phone function. Keeping in mind that the hearing system is to be applied to highly different individuals concerning education, age, culture, etc., by means of the man/machine interface 29 and menu-controlled or guided via machine/man interface 27, the specific individual user or another person, as e.g. an audiologist fitting the overall system to an individual, selects e.g. which messages shall be visually or acoustically displayed to the user and which messages are to be disabled. For acoustical messages a loudspeaker unit being part of the hardware configuration of the remote control device 1 may be used and/or the hearing device 3 with its respective electrical-to-acoustical output converter, e.g. loudspeaker. Messages of the following types may e.g. be generated and selected for respective display:

- Battery status of the hearing device;
- Indications of the operating status, mode or program selected or selectable for the hearing device 3; activated or activatable sound-cleaning tools for the audio display at the remote control device 1 and/or at the hearing device 3; feedback canceller mode and its activity at the hearing device 3;
- Radio broadcast channel which may be or are selected;
- Messages informative of the status of the individual wearing the hearing device of the system as e.g. in remote monitoring operation for a mother with respect to her hearing-impaired child wearing the hearing device 3, e.g. as a baby phone indicating "baby is sleeping", "baby is crying", etc.;
- Messages received or being sent or having been sent through mobile phone operation of the remote control device;
- Logging data e.g. and including acoustical history lived by the hearing device 3; such data may be sent by mobile phone appliance to a remote server. There, such data may be collected, analyzed and transmitted e.g. to a fitter's office, to the manufacturer, to a research lab, etc.;
- Messages about received information via the mobile phone appliance of the remote control device 1 may be displayed, e.g. with respect to settings of the hearing device which should be changed etc.;
- The remote control device 1 may be used as an acoustical dosimeter measuring sound and noise exposure over time, recording acoustical over-exposure, short- and long-term acoustical average values etc.;

Messages may be displayed for improved or expert use of the hearing aid, e.g. recommendations for program setting at the hearing device 3, etc.;

Results of logging data analysis may be displayed, messages about experienced preference settings for the hearing device to be accepted or rejected by the individual;

Messages concerning multimedia remote control via the remote control device 1 may be displayed as with respect to remote control of DVD, audio player, stereo equipment, etc.

It is evident that the addressed messages as explained above do also disclose the different appliances which may be performed by the remote control device 1 equipped with the respective hardware and operated by respective application programs AP.

As a part of the hardware configuration of the remote control device 1 a real-time clock may be provided. Time and/or date and/or time announcements, preset alarms may thereby be displayed visually and/or acoustically, generically via the machine/man interface 27 of FIG. 1 and/or the hearing device.

With a real-time clock being part of the hardware configuration of the remote control device 1 and with a respective application program AP the remote control device 1 can synchronize the hearing device 3 with time and weekday, e.g. in order to enable the hearing device 3 to operate accordingly in specific user preference modes. Logging of operation history of the system may thus not only contain e.g. the amount of operating hours, but may indicate as to when which event did happen, e.g. excessive loudness, erroneous handling, etc.

Thereby, logged events get a time stamp. Via its mobile phone appliance the hearing system may send acoustical "images" to a remote information system together with setting information of the hearing device 3 and time stamp for a remote analysis. Remotely sent advises for the user are received and displayed.

With an eye on hearing device control, the combined possibilities of hearing device control and of mobile phone appliance allows the remote control device 1 to act as a wireless relay for programming or more generically setting the hearing device 3 or just between a remote information system and the hearing device. Parameters, instructions, programs etc. are not anymore necessary to be stored in the non-volatile memory of the remote control device 1, but may just be buffered there in order to pass such data from a remote control instance to hearing device setting.

Even when the remote control device 1 operates as just addressed, the received parameters, instructions and programs may be back-upped within the remote control device 1 for the case the wireless link to the remote control system should become interrupted for a longer time.

As was already addressed, the remote control device 1 of the system according to the present invention—at least usually—is used for intrinsic hearing device remote control as well as for additional appliances depending on its hardware configuration and the application programs AP which are executed. The remote control device 1 may operate as a remote control for TV, radio or DVD etc. Due to the fact of combined appliances, on one hand hearing device control, on the other hand for remote audio system control, the remote control device 1 may automatically adjust the volume and program of the hearing device 3 and the volume of a remote audio system to optimally fit the individual.

As an example, whenever the volume of an external audio system is turned up to be too high, e.g. following up needs of further individuals listening to such audio system, the remote control device 1 will reduce automatically the volume at the signal processing unit 7 of hearing device 3 down to a safe level for the individual. Combined controlling of the different devices which contribute to the acoustical perception of the individual with the hearing device 3 by means of one centralized control device, leads to optimum setting possibilities of all the contributing systems for the one involved individual. The remote control device 1 may master all audio sources and provide for information which audio sources are most enjoyed by the individual, thereby contributing to classification accuracy of different hearing sources for setting preferences as e.g. preferred programs operating the signal processor 7.

The remote control device 1 may further be hardware equipped with an audio, video or TV player, whereby especially the equipment with an audio player may be additionally exploited for fitting the hearing device which may be performed directly with the remote control device 1 if a respective application program is executed.

The remote control device 1 as of the present invention may be a perfect platform for advanced mobile fitting procedures for the hearing device 3. Thereby, standard diagnostic procedures like in situ audiogram, sensogram, paliogram and the like may be registered by the remote control device 1. This is especially true considering the fact that the remote control device 1 may be hardware-configured to have an audio player with recording ability.

Thereby, it becomes clear that by respectively loaded fitting application programs test audio signals may be displayed to the individual and individual's response may be registered in the remote control device 1. Logging the combination of acoustical test signals and individual response, automated evaluation of such logging may be used for automatic setting of parameters of the transfer functions as applied by the signal processing unit at the hearing device 3.

The attractiveness of a remote control device for a hearing system is significantly improved. Instead of carrying a remote control for the hearing device, additionally to e.g. a PDA, a mobile phone and using additional remote control devices for other remote controllable devices, some or all the addressed functions are combined within the hearing device remote control device.

Nevertheless, hearing devices are applied to largely different individuals, e.g. as concerns age, culture, education etc., and it has further to be considered that a remote control device sophisticated as was described should be usable for a large scale of different hearing devices.

In FIG. 2 there is shown, in a representation in analogy to that of FIG. 1, a further embodiment of the system according to the present invention, whereat a selection of application programs is loaded into an application program storage 31*a* and whereat there is further selected by man interaction which of these application programs resident in the application program storage 31*a* are activated and executed.

Only the differences with respect to the embodiment as of FIG. 1 shall be described. Application programs are loaded into the application program storage 31*a*. Thereby, more than one hearing device-specific application program HDP1, HDP2 . . . are resident in the application program storage 31*a*, as well as a selection of application programs AP1, AP2 . . . that are not specifically hearing device related.

Which of these application programs HDP and AP are activated is selected by man interaction as schematically shown in FIG. 3 via man/machine interface 29*c* and selection unit 40. On one hand e.g. an audiologist fitting the overall system to a specific individual may select which of the application programs AP shall be activated to operatively control the embedded computer unit 23, on the other hand such person will decide which of the hearing device-specific application programs HDP shall be activated in dependency of the type of hearing device 3 to be remotely controlled by the remote control device 1.

By having the standard or most frequently used application programs loaded into the application program storage 31*a* of remote control device 1, one and the same remote control device 1 may be fitted to a huge number of different individuals and hearing devices.

In FIG. 3 there is shown a further embodiment departing from the representation as discussed and represented in FIG. 2. Thereby, whenever a hearing device 3 is first connected to the remote control device 1 or when a specific hearing device 3 is approached closer than a predetermined distance to a specific area at the remote control device 1, then, preferably man-triggered, a hearing device to remote control automatic device pairing is initiated. Such procedure is e.g. known from diving computers operating with remote pressure sensors at the air tank. Whenever such pairing is triggered, a hearing device-specific information is read by the embedded computer 23 of the remote control device 1 and once the specific hearing device 3 is recognized, there is automatically found, as schematically shown in FIG. 3 by means of a hearing device type/hearing device application program lookup table 42 which hearing device application program HDP is to be activated for the specific hearing device 3. The output of the lookup table 42 controls automatically the hearing device application program selection via selection unit 40*a*. As was already explained in context with FIG. 2, the other application programs AP to be activated are selected man-controlled via selection unit 40.

By this just described technique it becomes possible, on one hand, to apply one and the same remote control device for different hearing devices and to tailor such remote devices to individual needs.

On the other hand, the case may arise where an individual would like to change its remote control device and to keep the hearing device so as, as an example, to take into account, more sophisticated remote control devices which recently came on the market. Under this aspect, the role of hearing device and remote control device, which were explained in context with FIG. 3, i.e. where the remote control device identifies the hearing device and adapts itself to the needs of the specific hearing device, is inversed in that the hearing device identifies, as was addressed by automatic pairing, a changed remote control device and adapts its possibilities, which were e.g. not fully exploited, for the "old" remote control device to the changed remote control device.

Most generically by the addressed pairing of remote control device and hearing device specific single or bidirectional communication between the addressed devices is established for the first time for further intercommunication between the devices.

The invention claimed is:

1. A hearing system comprising at least one hearing device having a signal processing unit with a control input operationally connected to a device communication port, and a remote control device comprising a wireless communication port for single- or bi-directional wireless communication with said device communication port, an embedded computer in said remote control device operated by an operating system, an output thereof being operationally connected to said wireless communication port and to at least one machine/man interface at said remote control device, an input thereof being operationally connected to at least one man/machine interface at said remote control device, a set of hearing device-specific application programs executable by said embedded computer and corresponding to a plurality of different hearing device types, said remote control device being operatable via said man/machine interface to adjust at least the momentarily prevailing volume at said hearing device, wherein the remote control device identifies said hearing device and automatically selects and executes a hearing device-specific application program corresponding to the identified hearing device, from said set of hearing device-specific application programs corresponding to the plurality of different hearing device types.

2. The system of claim 1, at least a part of said hearing device-specific application programs of said set being commonly installed and selectively activatable for execution via said at least one man/machine interface.

3. The system of claim 2, said hearing device-specific application programs being activatable and settable under menu control.

4. The system of claim 1, wherein the remote control device selects and executes an application program in dependency of the needs of said individual.

5. The system of claim 1, wherein said machine/man interface comprises at least one of the following units: a color display, a loudspeaker unit, an electrical to mechanical output converter of the hearing device, an output connection plug at the remote control device.

6. The system of claim 1, wherein said man/machine interface comprises at least one of the following units: a touch screen, a microphone, a keypad, an acoustical-to-electrical input converter at the hearing device, an input connection plug at the remote control device.

7. The system of claim 1, wherein said remote control device comprises an input unit for loading application programs.

8. The system of claim 1, said remote control device being operatable as at least one of a PDA, a mobile phone, a radio broadcast receiver, a video player, an audio player, a TV receiver, a camera, a remote control for a device different from said hearing device, a fitting control device for said hearing device, a communication transit unit between said hearing device and a remote information system.

9. The system of claim 1, wherein when the hearing device is approached closer to the remote control device than a predetermined distance, the remote control device identifies said hearing device and automatically selects and executes the hearing device-specific application program corresponding to the identified hearing device.

10. The system of claim 1, wherein the signal processing unit provides a plurality of processing options, and wherein the hearing device identifies said remote control device and automatically recognizes options of the remote control device corresponding to options of said plurality of processing options, and enables the options of said plurality of processing options that correspond to the recognized options of the remote control device.

* * * * *